US010401775B1

(12) United States Patent
Tokuyama

(10) Patent No.: US 10,401,775 B1
(45) Date of Patent: Sep. 3, 2019

(54) SHEET GUIDING DEVICE AND IMAGE FORMING APPARATUS

(71) Applicant: FUJI XEROX CO., LTD., Tokyo (JP)

(72) Inventor: Atsuhito Tokuyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/153,845

(22) Filed: Oct. 8, 2018

(30) Foreign Application Priority Data

Jun. 20, 2018 (JP) ..... 2018-116947

(51) Int. Cl.
*G03G 15/00* (2006.01)
*G03G 15/16* (2006.01)
*B65H 5/06* (2006.01)

(52) U.S. Cl.
CPC ..... *G03G 15/6558* (2013.01); *B65H 5/062* (2013.01); *G03G 15/161* (2013.01); *G03G 15/5004* (2013.01); *G03G 15/165* (2013.01); *G03G 15/657* (2013.01)

(58) Field of Classification Search
CPC ..... G03G 15/1605; G03G 15/5004; G03G 15/657; G03G 15/1665; G03G 15/6558
See application file for complete search history.

(56) References Cited

U.S. PATENT DOCUMENTS

2007/0280750 A1* 12/2007 Kurosu ..... G03G 15/1605 399/316
2010/0129121 A1* 5/2010 Ichikawa ..... G03G 15/1695 399/316
2016/0170364 A1* 6/2016 Kogure ..... G03G 15/161 399/316

FOREIGN PATENT DOCUMENTS

| | | |
|---|---|---|
| JP | 3232887 | 11/2001 |
| JP | 2010008697 | 1/2010 |
| JP | 2010085491 | 4/2010 |

* cited by examiner

*Primary Examiner* — Walter L Lindsay, Jr.
*Assistant Examiner* — Jessica L Eley
(74) *Attorney, Agent, or Firm* — JCIPRNET

(57) ABSTRACT

A sheet guiding device includes: a first guiding unit that is grounded and guides a sheet transported; and a second guiding unit that is disposed on a downstream side of the first guiding unit and grounded with a resistance higher than a resistance with which the first guiding unit is grounded, and that guides the sheet transported to the first guiding unit to a transfer position interposed between an image carrier that carries a toner image and a transfer unit that transfers the toner image on the image carrier onto the transported sheet by pinching the sheet between the image carrier and the transfer unit and applying an electric field across the image carrier and the transfer unit. The first guiding unit has a dimension decrease area in which on a surface, in contact with the sheet, of the first guiding plate on the downstream side in the sheet transport direction, a dimensional value of a portion including a first material that is a same as the first material used as a material of another surface, in contact with the sheet, of the first guiding plate on an upstream side of the downstream side in a sheet width direction crossing the sheet transport direction is decreased at a more downstream position in the sheet transport direction.

20 Claims, 14 Drawing Sheets

SHEET GUIDING DEVICE AND IMAGE FORMING APPARATUS

CROSS-REFERENCE TO RELATED APPLICATIONS

This application is based on and claims priority under 35 USC 119 from Japanese Patent Application No. 2018-116947 filed Jun. 20, 2018.

BACKGROUND

(i) Technical Field

The present disclosure relates to a sheet guiding device and an image forming apparatus.

(ii) Related Art

When a member having a high resistance is used as a guiding member that guides transported paper sheets, a paper sheet may electrostatically adheres to the member to cause a transport error. Thus, the member is composed of a conductive material and grounded. However, in the case of a guiding member which is near a transfer position at which a toner image on an image carrier is electrostatically transferred onto a paper sheet, a resin with a high resistance on the order of several 100 Ω·m is used to avoid an adverse effect on the transfer.

Here, Japanese Unexamined Patent Application Publication No. 2010-085491 discloses a configuration in which a transported paper sheet is pinched between an upper transfer guide and a sheet member (lower transfer guide) which includes a conductive material and has one end supported by an insulating member.

Also, Japanese Unexamined Patent Application Publication No. 2010-008697 discloses a guiding member for which physical properties for stabilizing a charged state are defined.

SUMMARY

In recent years, application of image forming has spread so that an image is formed on a sheet of black paper on which the black color is adjusted with carbon, and a sheet made of a resin-coated aluminum sheet. These sheets have an extremely low electrical resistance as compared with a paper sheet in related art, and when the sheets are used, at the moment when a sheet transported is separated from a grounded guiding member including a conductive material, at a position slightly away from a transfer position, a current which flows through the sheet suddenly changes, and electrical control is not performed in time and a transfer error may occur. Such a transfer error occurs not only when a black paper or an aluminum sheet is used, but also may occur under conditions in which a current which flows through a sheet increases, depending on the property of the sheet itself or the usage environment.

Aspects of non-limiting embodiments of the present disclosure relate to a sheet guiding device and an image forming apparatus that suppress a sudden change of current which flows through a sheet.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a sheet guiding device including: a first guiding unit that is grounded and guides a sheet transported; and a second guiding unit that is disposed on a downstream side of the first guiding unit and grounded with a resistance higher than a resistance with which the first guiding unit is grounded, and that guides the sheet transported to the first guiding unit to a transfer position interposed between an image carrier that carries a toner image and a transfer unit that transfers the toner image on the image carrier onto the transported sheet by pinching the sheet between the image carrier and the transfer unit and applying an electric field across the image carrier and the transfer unit. The first guiding unit has a dimension decrease area in which on a surface, in contact with the sheet, of the first guiding plate on the downstream side in the sheet transport direction, a dimensional value of a portion including a first material that is a same as the first material used as a material of another surface, in contact with the sheet, of the first guiding plate on an upstream side of the downstream side in a sheet width direction crossing the sheet transport direction is decreased at a more downstream position in the sheet transport direction.

BRIEF DESCRIPTION OF THE DRAWINGS

Exemplary embodiments of the present disclosure will be described in detail based on the following figures, wherein:

FIGS. 4A-1 to 4C-2 are figures illustrating a phenomenon caused by the state in which a current is much less likely to flow suddenly.

DETAILED DESCRIPTION

Hereinafter, exemplary embodiments of the disclosure will be described.

Figure 1:
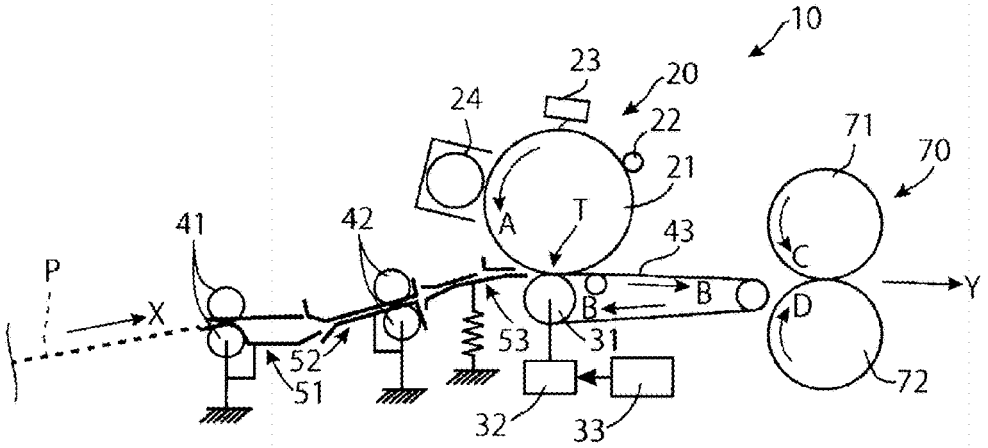
FIG. 1 is a schematic view illustrating the major components of an image forming apparatus according to an exemplary embodiment of the disclosure.

FIG. 1 is a schematic view illustrating the major components of an image forming apparatus according to an exemplary embodiment of the disclosure. The image forming apparatus illustrated in this FIG. 1 includes a sheet guiding device according to an exemplary embodiment of the disclosure.

An image forming apparatus 10 includes a toner image former 20. The toner image former 20 includes an image carrier 21 that rotates in the direction of an arrow A, and a charging unit 22, an exposure unit 23, and a developing unit 24 are further provided around the image carrier 21.

The charging unit 22 charges the image carrier 21. The exposure unit 23 radiates a charged area of the image carrier 21 with exposure light to form an electrostatic latent image on the image carrier 21. Furthermore, the developing unit 24 develops the electrostatic latent image on the image carrier 21 with toner to form a toner image on the image carrier 21. The image carrier 21 then carries the toner image formed, and transports the toner image to a transfer position T. At the transfer position T, a transfer bias applied to a transfer roller 31 causes the toner image transported to the transfer position T by the image carrier 21 to be transferred at the same transfer position T onto a paper sheet P transported in the manner as described below.

The paper sheet P is taken out from a sheet tray (not illustrated) which is disposed on the further upstream side of the illustrated portion of the image forming device 10, transported in the direction of an arrow X by a transport roller 41, guided by a guiding plate 51, further guided by a subsequent guiding plate 52, and the front end of the paper sheet P arrives at a timing adjustment roller 42. The paper sheet P is delivered toward the transfer position T by the timing adjustment roller 42 so that the paper sheet P arrives at the transfer position T at the same timing of arrival of the toner image formed on the image carrier 21 to the transfer position T. The paper sheet P delivered by the timing adjustment roller 42 is guided by another guiding plate 53 to arrive at the transfer position T.

Figure 2:
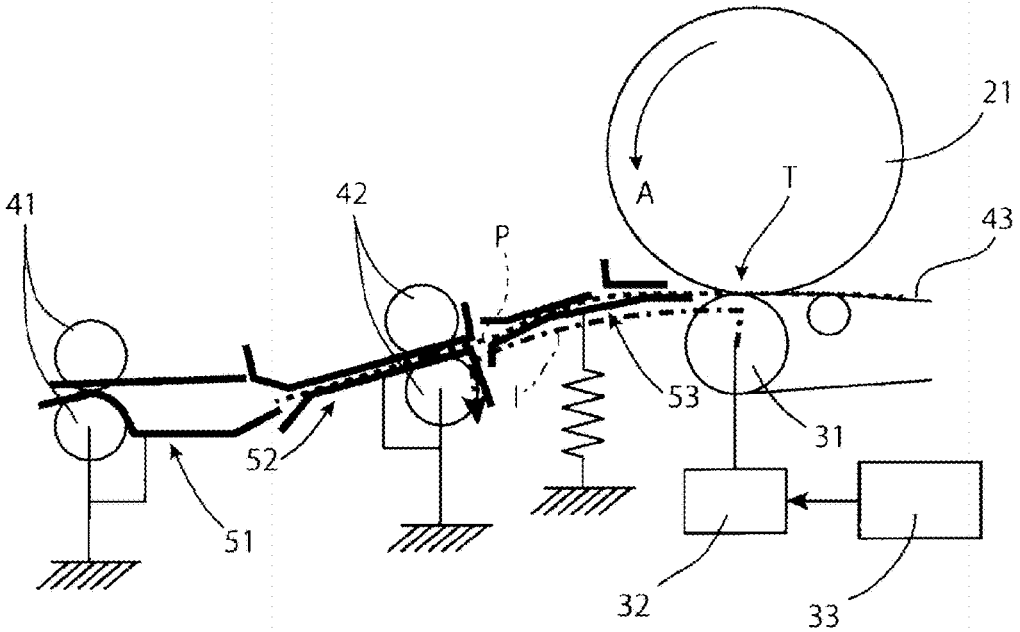
FIG. 2 is an enlarged view of a sheet transport path with a scale factor greater than the scale factor in FIG. 1, the sheet transport path being on the upstream side of a transfer position of the image forming apparatus illustrated in FIG. 1.
Figure 3:
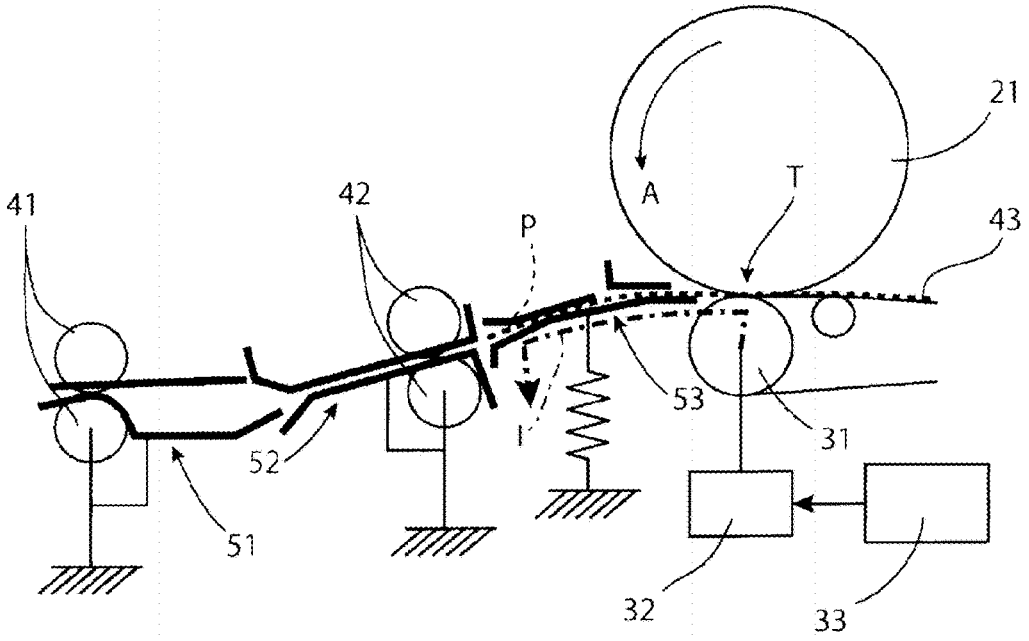
FIG. 3 is an enlarged view of a sheet transport path with a scale factor greater than the scale factor in FIG. 1, the sheet transport path being on the upstream side of a transfer position of the image forming apparatus illustrated in FIG. 1.

The two guiding plates 51, 52 on the upstream side are configurated with a metal plate, have excellent conductivity, and are grounded. This prevents an accident caused by the paper sheet P which may become electrostatically unstable and adhere to the guiding plates 51, 52. In contrast, the guiding plate 53 near the transfer position T is configurated with a resin which has an electrically high resistance to some extent. Although the guiding plate 53 is also grounded, a material with a high resistance is used, thus the guiding plate 53 is grounded with a high resistance. In FIG. 1 and FIG. 2, FIG. 3 described later, in order to show grounding with a high resistance, the figures include a resistor via which the guiding plate is grounded. However, a resistor does not actually need to be present.

In the exemplary embodiment, the guiding plate 52 and guiding plate 53 correspond to examples of a first guiding unit and a second guiding unit, respectively, in the present disclosure.

A transfer bias is applied to the transfer roller 31 by a power source 32. Here, as an example, a constant current source is used as the power source 32. When a constant current source is used as the power source 32, a controller 33 is used, which controls the current value of the constant current source. When a resistance value is changed, the constant current source changes the voltage of the transfer bias in order to maintain the current value set by the controller 33.

A constant voltage source may be used as the power source 32. When a constant voltage source is used as the power source 32, a controller 33 is used, which controls the voltage value of the constant voltage source. The constant voltage source continues to apply the transfer bias of the voltage set by the controller 33, thus when the set voltage is constant, a change in resistance value cause a change in current value.

The paper sheet P which has received transfer of a toner image from the image carrier 21 by the transfer bias applied to the transfer roller 31 is transported to a fixing unit 70 by a transport belt 43 which performs circulation movement in the direction of an arrow B. The fixing unit 70 includes a heating roller 71 that rotates in the direction of an arrow C and a pressure roller 72 that rotates in the direction of an arrow D. The sheet which has received transfer of a toner image and been transported to the fixing unit 70 is pinched between the heating roller 71 and the pressure roller 72 to be heated and pressurized, and an image including a fixed toner image is formed on the paper sheet P. The paper sheet P, on which the image is formed, is discharged to the outside of the image forming apparatus 10 in the direction of an arrow Y.

FIGS. 2 and 3 are each an enlarged view of a sheet transport path with a scale factor greater than the scale factor in FIG. 1, the sheet transport path being on the upstream side of a transfer position of the image forming apparatus illustrated in FIG. 1. FIG. 2 illustrates a state where the rear end of the paper sheet P is in contact with the guiding plate 52. In addition, FIG. 3 illustrates a state immediately after the rear edge of the paper sheet P is separated from the guiding plate 52 after being further transported.

It is assumed that the rear end of the paper sheet P transported in the direction of an arrow X is still in contact with the guiding plate 52 as illustrated in FIG. 2. The guiding plate 52 is a metal plate having excellent conductivity, and is grounded along with the timing adjustment roller 42. In contrast, another guiding plate 53 near the transfer position T is made of a resin with a high resistance on the order of several 100 Ω·m, and is grounded. However, a current is much less likely to flow, as compared with the guiding plate 52. Therefore, when the rear end of the paper sheet P is in contact with the guiding plate 52 as illustrated in FIG. 2, a current I which flows through the paper sheet P due to the transfer bias applied to the transfer roller 31 flows through the guiding plate 52, or when the rear end of the paper sheet P is in contact with the timing roller 42, the current I flows through the timing roller 42. The current value I at this point is mainly determined by the resistance value of the paper sheet P.

When the paper sheet P is further transported in the direction of the arrow X, and the rear edge of the paper sheet P is separated from the metal guiding plates 52 as illustrated in FIG. 3, the current which flows through the guiding plate 52 is blocked at that moment. After this moment, the current I which flows through the paper sheet P flows through the guiding plate 53. Here, the guiding plate 53 has a pretty high resistance (several 100 Ω·m), as compared with the guiding plate 52 on the upstream side, thus in the stage before the later-described measure according to the exemplary embodiment of the present disclosure is taken, at the moment when the rear edge of the paper sheet P is separated from the metal guiding plate 52, the current I becomes much less likely to flow suddenly and the current value is suddenly decreased.

FIGS. 4A-1 to 4C-2 are figures illustrating a phenomenon caused by the state in which a current is much less likely to flow suddenly. However, FIGS. 4A-1 to 4C-2 are examples before the measure according to the exemplary embodiment of the present disclosure is taken. In other words, FIGS. 4A-1 to 4C-2 are figures as comparative examples of the present disclosure.

Here, the resistance determined by the transfer bias voltage applied to the transfer roller 31 by the power source 32 illustrated in FIGS. 1 to 3, and a current which flows through the transfer roller 31 is referred to as the "overall resistance".

Here, a toner image with a uniform density is formed on the image carrier 21, and is transferred onto the paper sheet P. FIGS. 4A-1, 4B-1, and 4C-1 each illustrate a toner image transferred onto the paper sheet P, or an image obtained by fixing the toner image. Here, in spite of the formation of a uniform toner image on the image carrier 21, defective images with variation in density are formed on the paper sheet P as illustrated in FIGS. 4(A-1), 4(B-1), and 4(C-1). Also, FIGS. 4A-2, 4B-2, and 4C-2 illustrate explanatory diagrams for a cause of formation of defective images illustrated in FIGS. 4A-1, 4B-1, and 4C-1, respectively. The sudden change in overall resistance illustrated in FIGS. 4A-2, 4B-2, and 4C-2 occurs at the moment when the rear edge of the paper sheet P is separated from the guiding plate 52.

Figures 1, 4A:
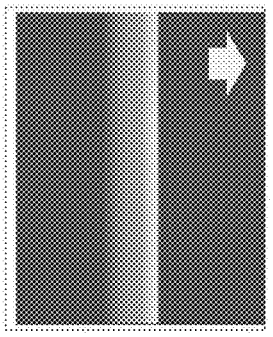
Figures 2, 4A:
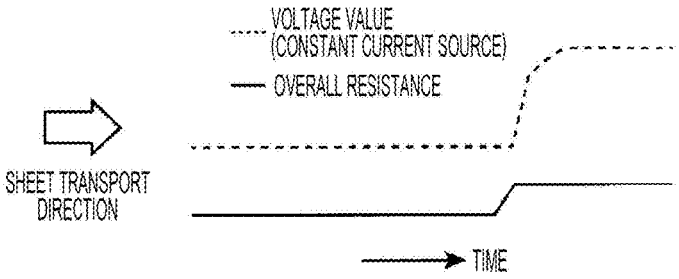

FIGS. 4A-1 and 4A-2 illustrate examples when a constant current source is used as the power source 32.

When the rear edge of the paper sheet P is separated from the guiding plate 52, the overall resistance is suddenly increased at that moment, and a current which flows through the paper sheet P is suddenly decreased. Since a constant current source is used in FIGS. 4A-1 and 4A-2, when the overall resistance is increased, the power source 32 as the constant current source increases the transfer bias voltage in order to maintain the current value instructed by the controller 33. However, transfer bias voltage control is performed by the constant current source after detection of a change in the overall resistance, thus time delay occurs. Therefore, when the change in the overall resistance is too sudden, the constant current source may not follow the sudden change, and a transfer error continues to occur until the constant current source follows the change as illustrated in FIG. 4A-1. Thus, stripe variation in density occurs on the paper sheet P, which extends in the sheet width direction crossing the sheet transport direction.

Figures 1, 4B:
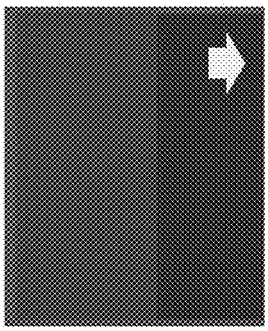
Figures 2, 4B:
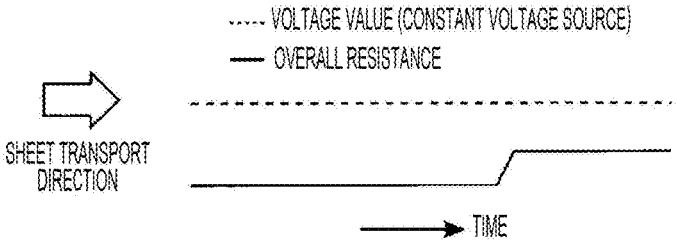

FIGS. 4B-1 and 4B-2 illustrate examples when a constant voltage source is used as the power source 32. Here, the controller 33 is assumed to give an instruction that a constant voltage value should be maintained.

In this case, when the overall resistance is suddenly changed, the current value due to the transfer bias is suddenly changed, and since the voltage is fixed, the density of an image on the paper sheet P is changed stepwise as illustrated in FIG. 4B-l.

Similarly to FIGS. 4B-1 and 4B-2, FIGS. 4C-1 and 4C-2 illustrate examples when a constant voltage source is used as the power source 32. However, here, the control unit 33 is assumed to give an instruction that the voltage should be changed stepwise. Specifically, the timing of sudden change in the overall resistance and the resistance value before and after a change in the overall resistance are predictable, thus at the timing of change in the overall resistance, the controller 33 changes the voltage specified to the power source 32 (constant voltage source) by an amount corresponding to an amount of change in the overall resistance stepwise.

Figures 1, 4C:
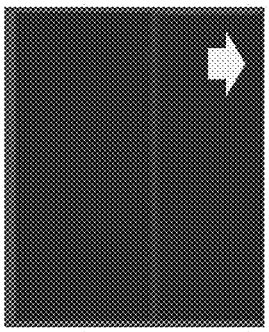
Figures 2, 4C:
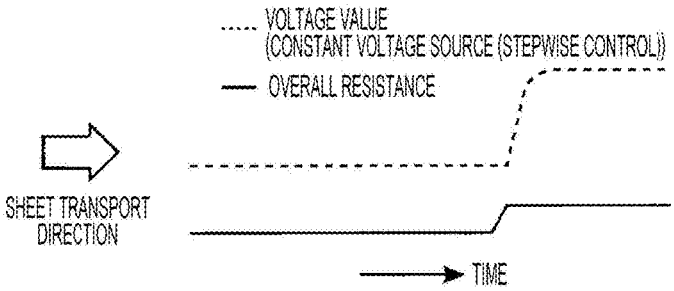

If the control is performed without an error, no variation in density appears on the image on the paper sheet P. However, the timing of separation of the rear edge of the paper sheet P from the guiding plate 52 is not thoroughly predictable, and a predicted timing has an error. When change in transfer bias is delayed by an amount corresponding to the error, an image defect with a decreased density as illustrated in FIG. 4C-1 appears on an image on the paper sheet P, or when change in transfer bias is too quick, an image defect with an increased density may appear.

Based on the above, the characteristics of various exemplary embodiments of the present disclosure will be described.

Figure 5:
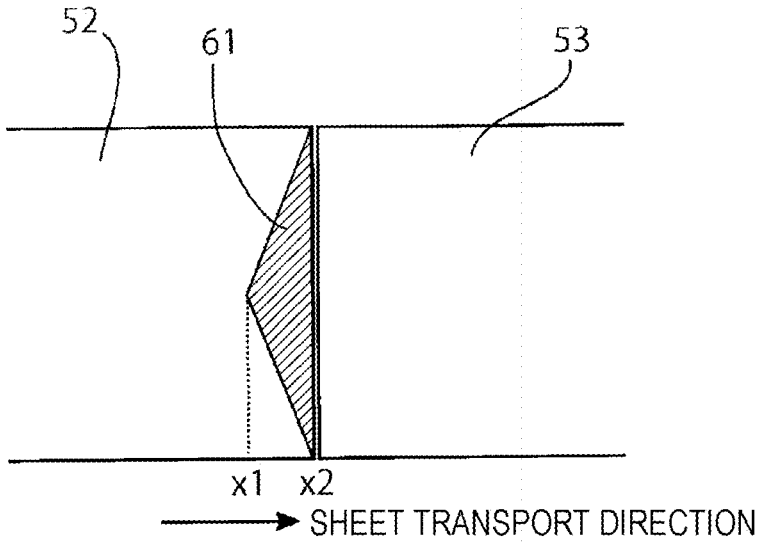
FIG. 5 is a schematic view illustrating the boundary section between two guiding plates in a first exemplary embodiment of the disclosure.

FIG. 5 is a schematic view illustrating the boundary section between two guiding plates in the first exemplary embodiment of the disclosure. FIG. 5 illustrates the surfaces, with which the paper sheet P is to be in contact, of the two guiding plates 52, 53. Here, a sheet 61 is bonded to the downstream-side end of the guiding plate 52 with a low resistance on the upstream side in the sheet transport direction. The sheet 61 is a sheet with a high resistance approximately 10 GΩ/□.

It is to be noted that volume resistance and surface resistance are not strictly distinguished, and when a current which has flowed through the paper sheet P is passed through a ground point, easiness of flow (difficulty of flow) is referred to as a resistance or a resistance value. Thus, in order to know the resistance value of a metal surface, with which the paper sheet P is in contact, of the guiding plate 52, a tester only has to be applied to the metal surface in contact with the paper sheet and the ground point to measure the resistance value therebetween. In order to know the resistance value of a portion, to which the sheet 61 is bonded, of the guiding plate 52, a tester only has to be applied to the surface, to be in contact with the paper sheet, of the sheet 61, and the ground point to measure the resistance value therebetween. The same goes with another guiding plate 53 and the later-described sheet 63. Here, when thus measured resistance values are compared, an expression such as the following is used: the sheet 63 has a higher resistance than the metal surface of the guiding plate 52.

Among the image forming apparatuses, a type of image forming apparatus is known, which once transfers a toner image on an image carrier onto an intermediate transfer belt, and transfers the toner image again on a paper sheet. As the sheet 61 illustrated in FIG. 5, for instance, a sheet including the same material as that of the intermediate transfer belt may be used.

The most of the current which flows through the paper sheet P is blocked in a portion in contact with the sheet 61. The sheet 61 illustrated in FIG. 5 has a triangle shape that has a vertex at the center in the sheet width direction on the upstream side in the sheet transport direction, and has a larger width in the sheet width direction at a more downstream position. Therefore, the rear edge of the paper sheet P transported passing through the sheet 61 is kept in contact with metal which is a material of a surface, to be in contact with a paper sheet on the upstream side, of the guiding plate 52 in the entire sheet width direction until the paper sheet P arrives at a position x1. When the rear edge of the paper sheet P is transported to the downstream side of the position x1, the length of the rear edge in contact with the metal surface in the sheet width direction is gradually reduced. When the rear edge of the paper sheet P arrives at the edge (position x2) of the guiding plate 52 on the downstream side, the paper sheet P is no longer in contact with the metal surface of the guiding plate 52. Therefore, the above-mentioned overall resistance is gradually changed over a period in which the rear edge of the paper sheet P is moved from the position x1 to the position x2. Consequently, a sudden change in the overall resistance as illustrated in FIGS. 4A-2, 4B-2, and 4C-2 is reduced.

Figure 6A:
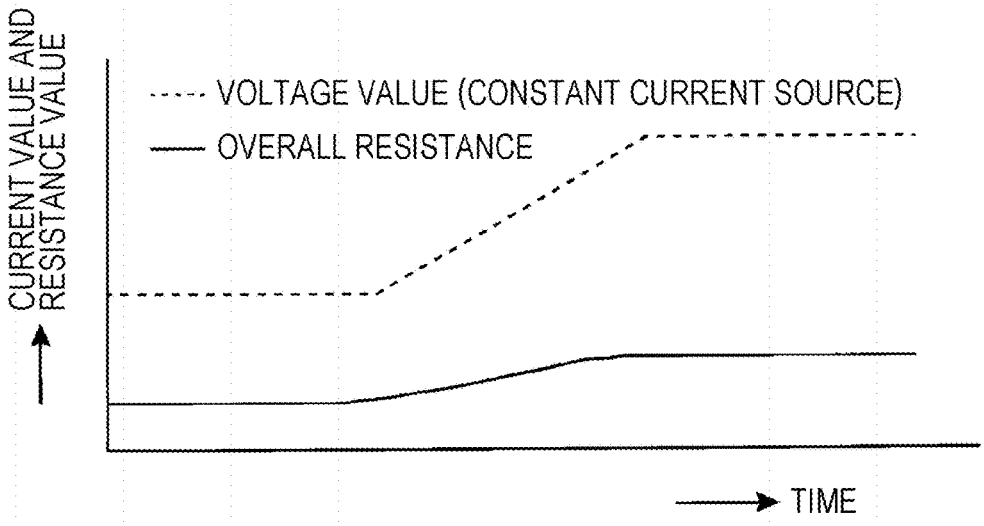
FIGS. 6A and 6B are graphs illustrating the change in overall resistance and the change in transfer bias when the sheet illustrated in FIG. 5 is bonded.
Figure 6B:
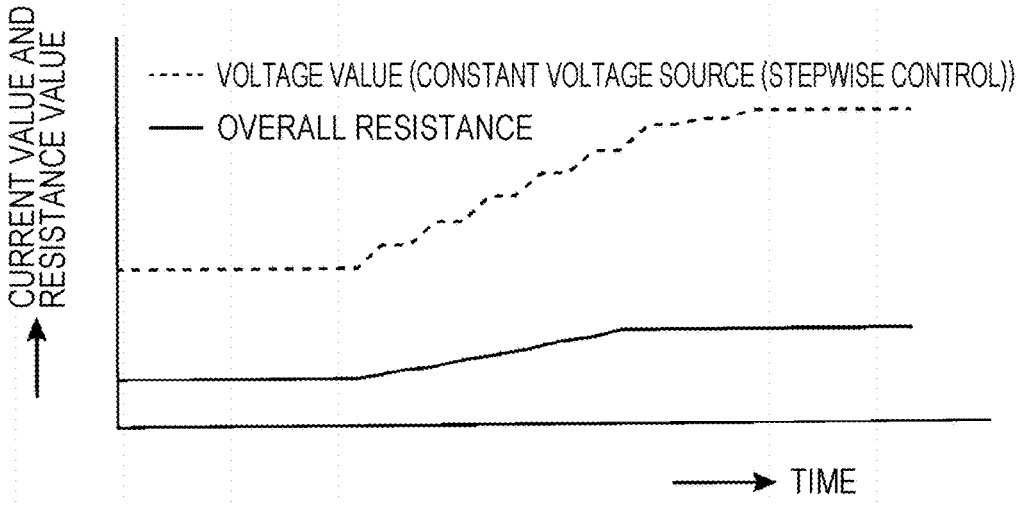

FIGS. 6A and 6B are graphs illustrating the change in overall resistance and the change in transfer bias when the sheet illustrated in FIG. 5 is bonded.

As illustrated in FIGS. 6A and 6B, the change in overall resistance is gradual due to the bonding of the sheet 61.

Here, FIG. 6A illustrates the case where a constant current source is used as the power source 32. Since the change in overall resistance is gradual, when a constant current source is used as the power source 32, an operation to maintain a constant current value performed by the constant current source substantially follows the change in overall resistance, thereby reducing appearance of variation in density of an image on the paper sheet P.

Also FIG. 6B illustrates the case where a constant voltage source is used as the power source 32, and control is performed to change the voltage value stepwise. In this case, even when the stepwise change in voltage and the change in overall resistance occur at some extent different timings, since the change is gradual, thereby reducing appearance of variation in density at an unacceptable level of an image on the paper sheet P.

It is to be noted that although use of a sheet with a high resistance as the sheet 61 has been described, the sheet 61 itself may have a low resistance, and an adhesive which bonds the sheet to the guiding plate 52 may have a high resistance.

Figure 7A:
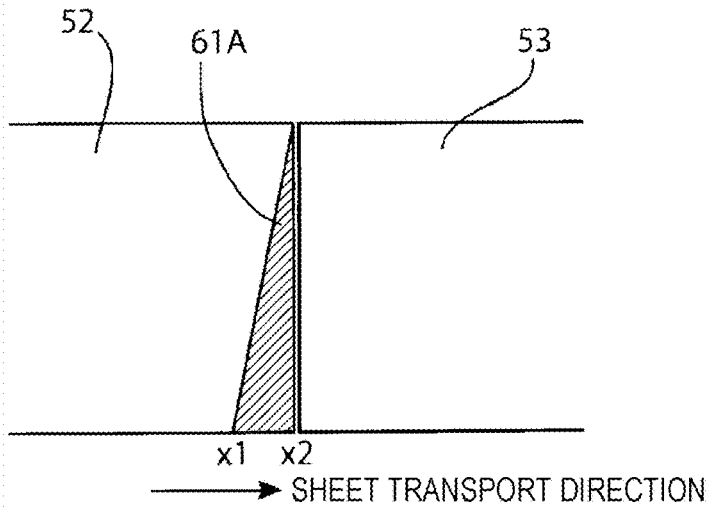
FIGS. 7A to 7C are views illustrating various modifications of the first exemplary embodiment.
Figure 7B:
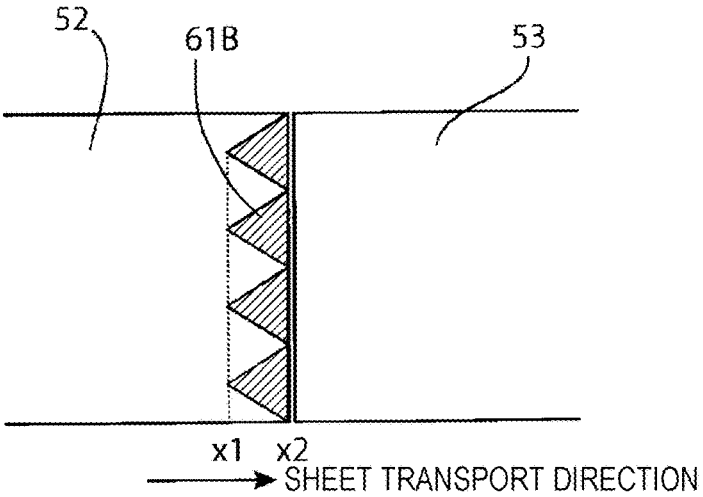
Figure 7C:
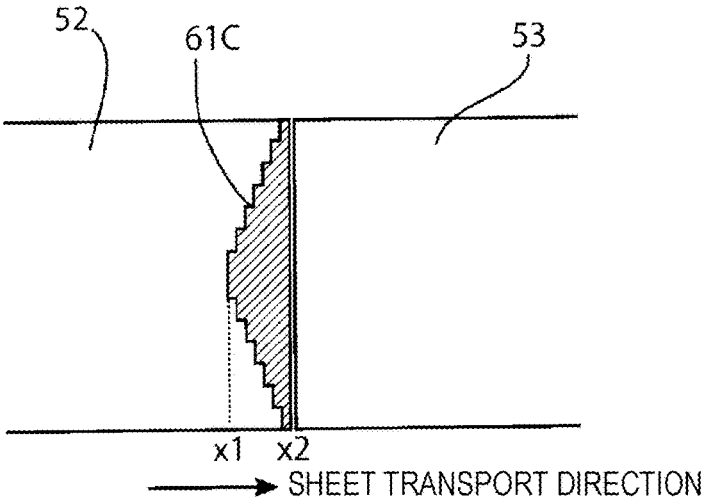

FIGS. 7A to 7C are views illustrating various modifications of the first exemplary embodiment.

The sheet bonded to the guiding plate may have a shape in which the sheet gradually covers the metal surface, facing the paper sheet, of the guiding plate 52 at a more downstream position, in other words, from the position x1 to the position x2, and the length of an exposed metal portion in the width direction is gradually decreased at a more downstream position.

Therefore, the sheet bonded to the guiding plate may be a triangular sheet 61A having a vertex at a widthwise end as illustrated in FIG. 7A. The shape is effective for an image forming apparatus in which paper sheets with multiple sheet widths are used, and which adopts a structure for transporting a paper sheet along the lower end side of FIG. 7A regardless of the sheet widths.

Also, the sheet bonded to the guiding plate may be a sheet 61B in which multiple triangles are arranged in the sheet width direction as illustrated in FIG. 7B.

In the case of the sheet 61 consisting of a single triangle illustrated in FIG. 5, while the rear edge of the paper sheet P is being transported from the position x1 to the position x2, a current is blocked by the sheet 61 at the central portion of the paper sheet P in the sheet width direction, whereas a current continues to flow at both ends. Thus, the current, which continues to flow through the paper sheet P, has a distribution in the sheet width direction. In contrast, when the sheet 61B including multiple triangles as illustrated in FIG. 7B is used, the height of a current distribution in the sheet width direction is reduced.

FIG. 7C is a triangular sheet 61C which has the same overall shape as that of the sheet 61 of FIG. 5, but has step-shaped oblique sides. Like this, the sheet 61C, in which the dimensional value in the sheet width direction is changed stepwise, may be used. In the present disclosure, "the dimensional value of a portion, in contact with a paper sheet transported, of the guiding plate in the sheet width direction is decreased at a more downstream position in the sheet transport direction" indicates a concept that includes the stepwise decrease as illustrated in FIG. 7C.

The description of the first exemplary embodiment and its modifications of the present disclosure has been completed so far, and the second exemplary embodiment and subsequent various exemplary embodiments and its modifications will be described. However, in the description of various exemplary embodiments and its modifications below, a description of common components with the first embodiment will be omitted, and points of difference will be described.

Figure 8A:
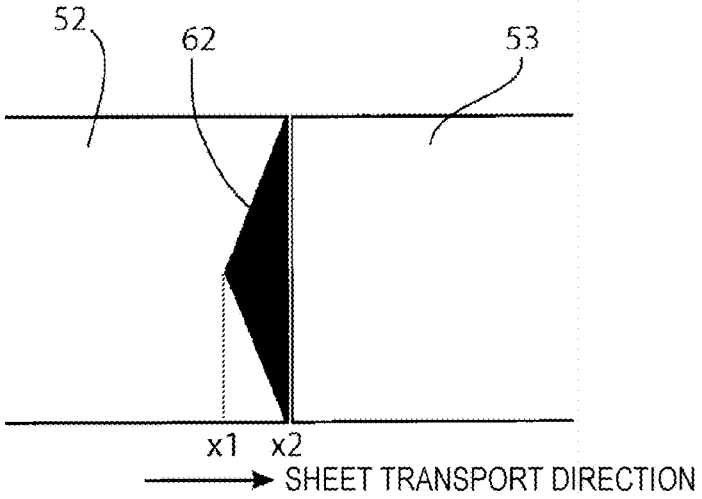
FIGS. 8A to 8C are views illustrating characteristic portions in a second exemplary embodiment (8A) and its modifications (8B, 8C)
Figure 8B:
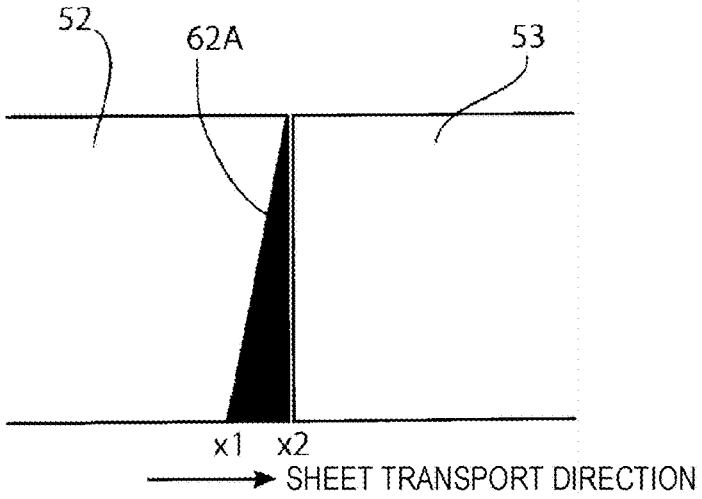
Figure 8C:
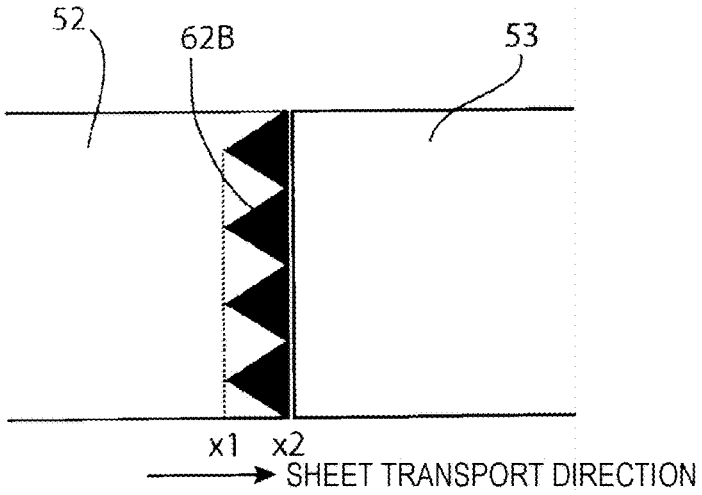

FIGS. 8A to 8C are views illustrating characteristic portions in the second exemplary embodiment (8A) and its modifications (8B, 8C). FIGS. 8A to 8C and FIGS. 9A to 9D and subsequent figures described later correspond to FIG. 5 to FIGS. 7A to 7C in the first exemplary embodiment.

In the first exemplary embodiment (see FIG. 5) and the modifications (see FIGS. 7A to 7C), sheets with a high resistance 61, 61A, . . . are bonded to the guiding plate 52. In the second exemplary embodiment and the modifications, however, instead of the sheets 61, 61A, . . . , coatings 62, 62A, 62B having a higher resistance than that of the metal as the base material of the guiding plate 52 are applied to the end of the guiding plate 52 on the downstream side. The shape of the applied coatings is the same as that of the sheets 61, 61A, . . . in the first exemplary embodiment and the modifications. It is to be noted that in FIGS. 8A to 8C, illustration of the coating applied to a shape corresponding to the step-shaped triangular sheet 61C in FIG. 7C is omitted.

As in the second exemplary embodiment and the modifications, the change in overall resistance can be made gradual by application of a coating having a high resistance.

FIGS. 9A to 9D are views illustrating characteristic portions in a third exemplary embodiment (9A) and its modifications (9B to 9D).

Figure 9A:
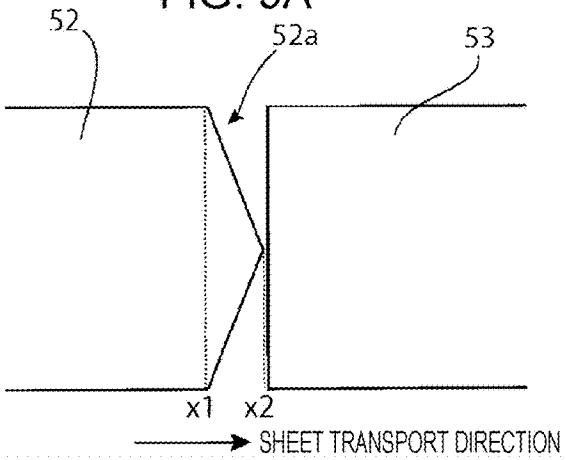
FIGS. 9A to 9D are views illustrating characteristic portions in a third exemplary embodiment 9A and its modifications 9B to 9D.

FIG. 9A has a shape in which the sheet widthwise dimensional value of a downstream-side end 52*a* of the guiding plate 52 in the sheet transport direction is smaller at a more downstream point. Therefore, the length of the rear edge (the edge of the paper sheet P on the upstream side in the transport direction), in contact with the guiding plate 52, of the paper sheet P transported passing through the downstream-side end 52*a* is decreased during a period since pass through of the position x1 until pass through of the position x2, and the overall resistance is gradually increased accordingly. Consequently, the change in overall resistance becomes gradual, and an adverse effect on the image on the paper sheet P is reduced.

Figure 9B:
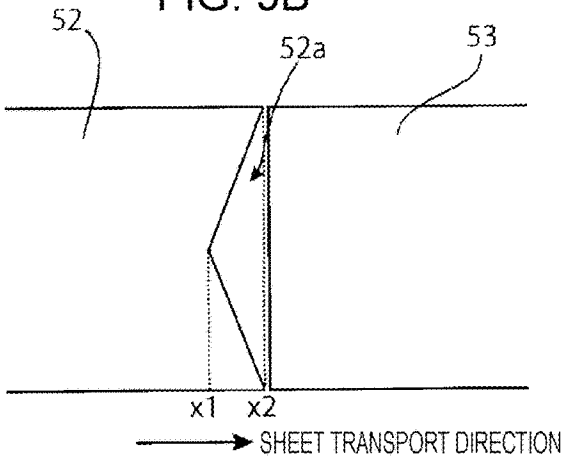

In the case of the modification of FIG. 9B, the edge of the guiding plate 52 on the downstream side in the sheet transport direction has a shape which is triangularly cut. This shape is also one of the shapes in which the dimensional value of a portion, in contact with the transported paper sheet P, of the guiding plate 52 in the sheet width direction is decreased at a more downstream position in the sheet transport direction. Consequently, the change in overall resistance becomes gradual, and an adverse effect on the image on the paper sheet P is reduced.

Figure 9C:
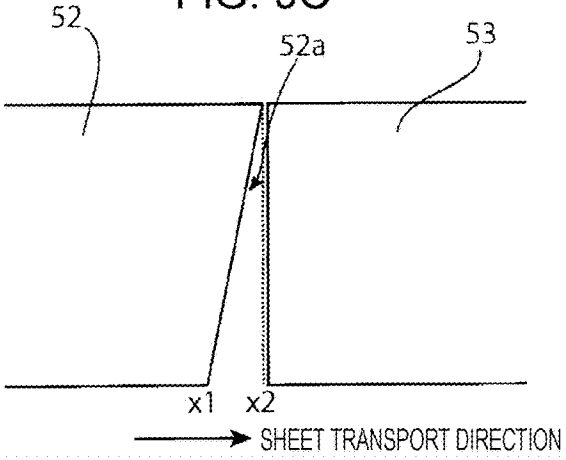

In the case of the modification of FIG. 9C, the edge of the guiding plate 52 on the downstream side in the sheet transport direction has a shape which is diagonally cut. This shape is also one of the shapes in which the dimensional value of a portion, in contact with the transported paper sheet P, of the guiding plate 52 in the sheet width direction is decreased at a more downstream position in the sheet transport direction. Consequently, the change in overall resistance becomes gradual, and an adverse effect on the image on the paper sheet P is reduced.

Figure 9D:
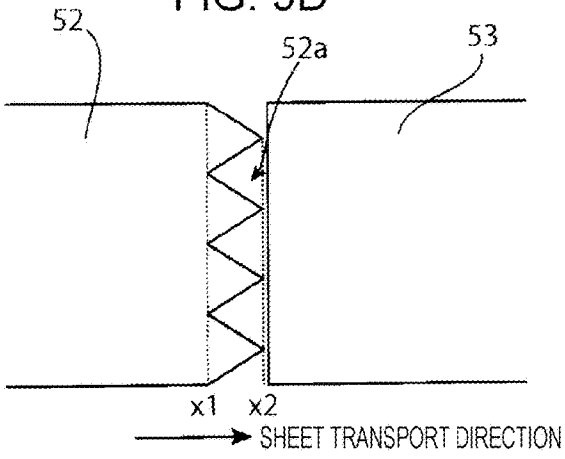
Figure 10A:
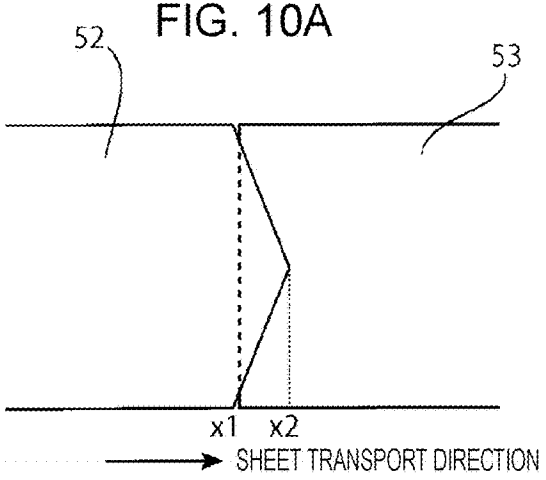
FIGS. 10A to 10D are views illustrating characteristic portions in a fourth exemplary embodiment 10A and its modifications 10B to 10D.
Figure 10B:
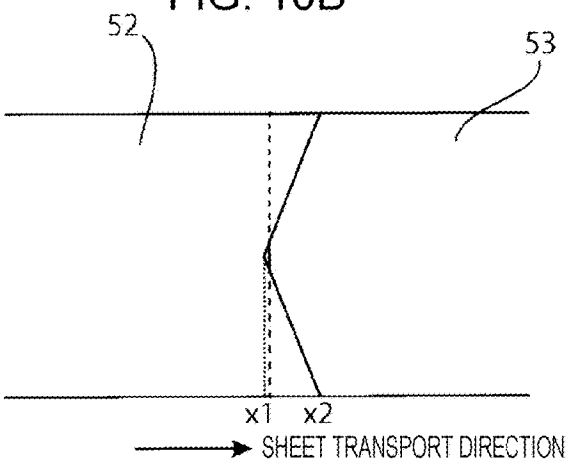
Figure 10C:
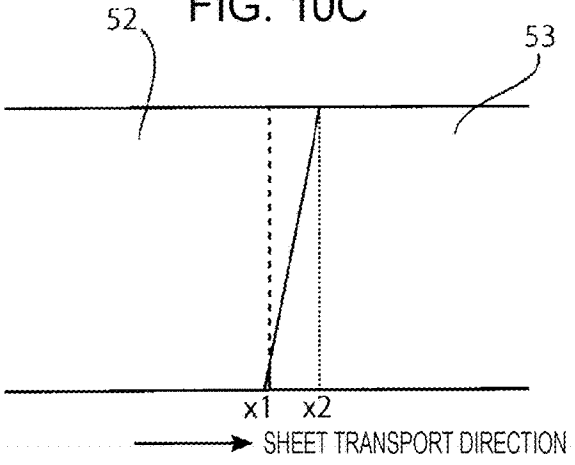
Figure 10D:
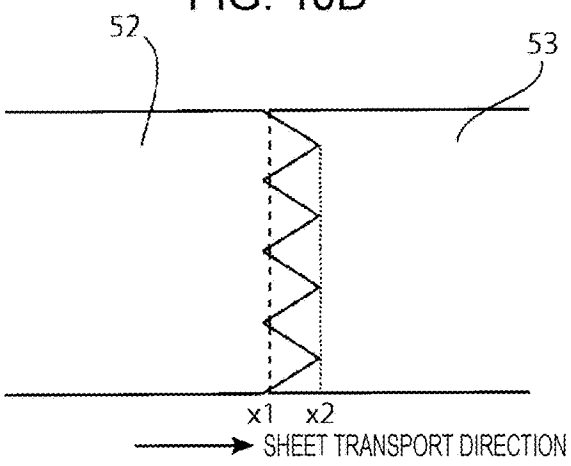
Figure 11A:
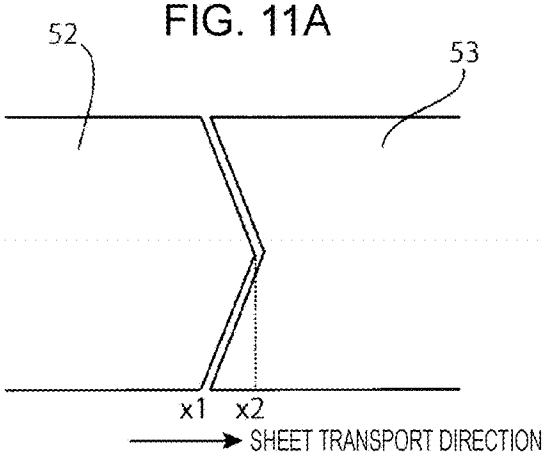
FIGS. 11A to 11D are views illustrating characteristic portions in a fifth exemplary embodiment 11A and its modifications 11B to 11D.
Figure 11B:
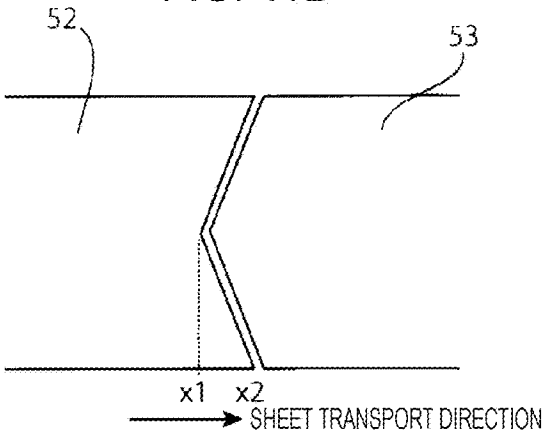
Figure 11C:
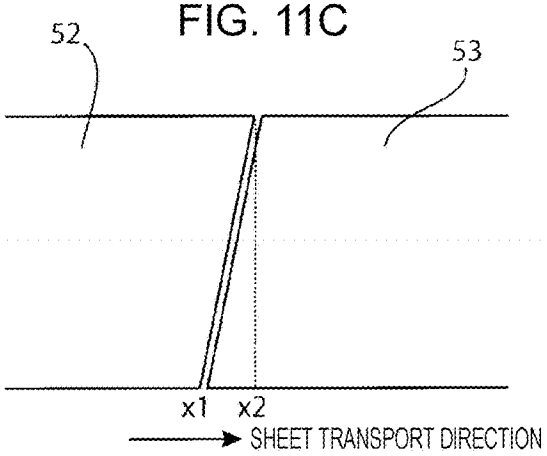
Figure 11D:
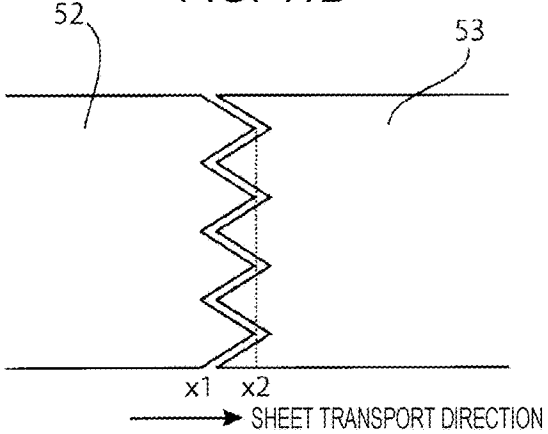

In the case of the modification of FIG. 9D, the edge of the guiding plate 52 on the downstream side in the sheet transport direction has a shape which is cut zigzag. This shape is also one of the shapes in which the dimensional value of a portion, in contact with the transported paper sheet P, of the guiding plate 52 in the sheet width direction is decreased at a more downstream position in the sheet transport direction. Consequently, the change in overall resistance becomes gradual, and an adverse effect on the image on the paper sheet P is reduced.

The shapes, in which the dimensional value of a portion, in contact with the transported paper sheet P, of the guiding plate 52 in the sheet width direction is decreased at a more downstream position in the sheet transport direction, illustrated in FIGS. 9A to 9D correspond to examples of the first shape in the present disclosure.

FIGS. 10A to 10D are views illustrating characteristic portions in a fourth exemplary embodiment (10A) and its modifications (10B to 10D).

FIGS. 10A to 10D illustrate configuration in which the downstream-side end 52*a* of the guiding plate 52 in the sheet transport direction is stacked on the guiding plate 53 in FIGS. 9A to 9D.

In FIGS. 9A to 9D, the downstream-side end 52*a* of the guiding plate 52 in the sheet transport direction has a shape which is cut out, thus space is present between the two guiding plates 52, 53 accordingly. Thus, the front end of the transported paper sheet P may be caught in the space, and the possibility of a transport error is increased. Thus, the guiding plate 52 is stacked on the guiding plate 53 as illustrated in FIGS. 10A to 10D to reduce the possibility of a transport error.

In the case of such a configuration in which the guiding plate 52 is stacked on the guiding plate 53, the effect of making the change in overall resistance gradual is maintained as it is.

FIGS. 11A to 11D are views illustrating characteristic portions in a fifth exemplary embodiment (11A) and its modifications (11B to 11D).

The shapes of the guiding plates 52 on the upstream side in FIGS. 11A to 11D are the same as the shapes of the guiding plates 52 of FIGS. 9A to 9D, respectively. The point of difference between FIGS. 11A to 11D and FIGS. 9A to 9D is the shape of the upstream-side edge of the guiding plate 53 on the downstream side in the sheet transport direction. In FIGS. 11A to 11D, the upstream-side edge of the guiding plate 53 on the downstream side in the sheet transport direction has a shape that conforms with the downstream-side edge of the guiding plate 52 in the sheet transport direction. In other words, in the case of FIGS. 11A to 11D, the upstream-side edge of the guiding plate 53 on the downstream side in the sheet transport direction has a shape in which the length of a portion, in contact with the transported paper sheet P, of the guiding plate 53 in the sheet width direction is increased at a more downstream position in the sheet transport direction.

Also in the case of the structures of FIGS. 11A to 11D, the space between the two guiding plates 52, 53 is reduced, and the possibility of a transport error caused by the front end of the transported paper sheet P being caught in the space is reduced. In addition, in the case of the structures of FIGS. 11A to 11D, similarly to FIGS. 9A to 9D, the effect of making the change in overall resistance gradual is maintained.

Here, the shape of the upstream-side edge of the guiding plate 53 in the sheet transport direction conforming with the downstream-side edge of the guiding plate 52 in the sheet transport direction in FIGS. 11A to 11D correspond to examples of the second shape in the present disclosure.

In the third to fifth exemplary embodiment and their modifications illustrated in FIGS. 9A to 11D, although the downstream-side edge of the guiding plate 52 has a shape in which the dimensional value of a portion, in contact with the transported paper sheet, of the guiding plate 52 in the sheet width direction crossing the sheet transport direction is decreased at a more downstream position in the sheet transport direction, in order to decrease the dimensional value of a portion, in contact with the transported paper sheet, of the guiding plate 52 in the sheet width direction crossing the sheet transport direction, the shape of the downstream-side edge of the guiding plate 52 is not necessarily to be used.

For instance, the downstream-side edge of the guiding plate 52 may have an area in which a depressed portion is formed, the depressed portion having a shape in which the length of a portion separated from the transported paper sheet in the sheet width direction crossing the sheet transport direction is increased at a more downstream position in the sheet transport direction. Specifically, the area to which the sheets 61, 61A, . . . are bonded in FIG. 5 or FIGS. 7A to 7C may be a depressed portion which is lowered by one level so as not to come into contact with the transported paper sheet P.

The exemplary embodiments and their modifications above (see FIG. 5, FIGS. 7 to 11D) and the exemplary embodiment in which the above-mentioned depressed portion is formed are various examples having the "dimension decrease area" in the present disclosure. Specifically, the exemplary embodiments above meet the requirements for the "dimension decrease area" in the present disclosure, in which "on the surface, in contact with a paper sheet, of the guiding plate 52 on the downstream side in the sheet transport direction, the dimensional value of a portion including a first material (here, metal) that is the same as the first material (metal) used as a material of the surface, in contact with the transported paper sheet, of the guiding plate 52 on the upstream side in the sheet width direction crossing the sheet transport direction is decreased at a more downstream position in the sheet transport direction.

Hereinafter, different exemplary embodiments and their modifications will be further described.

FIGS. 12A to 12E are views illustrating characteristic portions in a sixth exemplary embodiment 12A and its modifications 12B to 12E.

Figure 12A:
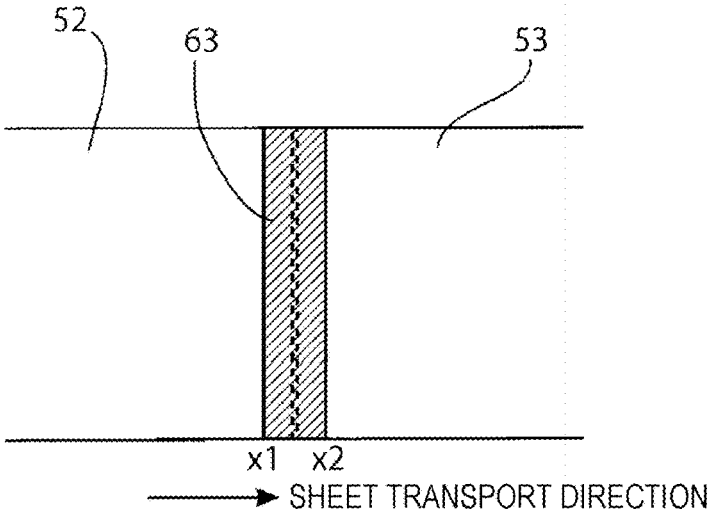
FIGS. 12A to 12E are views illustrating characteristic portions in a sixth exemplary embodiment 12A and its modifications 12B to 12E.

In FIG. 12A, a sheet 63 having a dimensional value covering the entire width of the guiding plates 52, 53 is bonded over the two guiding plates 52, 53. However, in contrast to the sheet having a high resistance, which has been described with reference to FIG. 5, FIGS. 7 to 11D, the sheet 63 has an intermediate resistance value (for instance, 1 kΩ/□) which is higher than the resistance value of the guiding plate 52 and lower than the resistance value of the guiding plate 53. It is to be noted that the sheet 63 itself is a sheet having a resistance value almost as low as the resistance value of the guiding plate 52, and an adhesive, with which the sheet 63 is bonded to the guiding plates 52, 53, may have the above-mentioned intermediate resistance value.

In the case of FIG. 12A, the overall resistance changes at two times: one is when the rear edge of the transported paper sheet P starts to overlap with the sheet 63 (the moment when the rear edge of the paper sheet P passes through the position x1), and the other is when the rear edge is starts to be separated from the sheet 63 and placed on the guiding plate 53 (the moment when the rear edge of the paper sheet P passes through the position x2). In this case, the change in overall resistance is distributed over two positions, and accordingly, the change in overall resistance for one time is decreased, and an adverse effect on the image on the paper sheet P is reduced.

The sheet 63 of FIG. 12A and sheets 63A to 63J in the later-described modifications of FIGS. 12B to 12E and FIGS. 13A to 13F correspond to examples of the third member in the present disclosure.

Figure 12B:
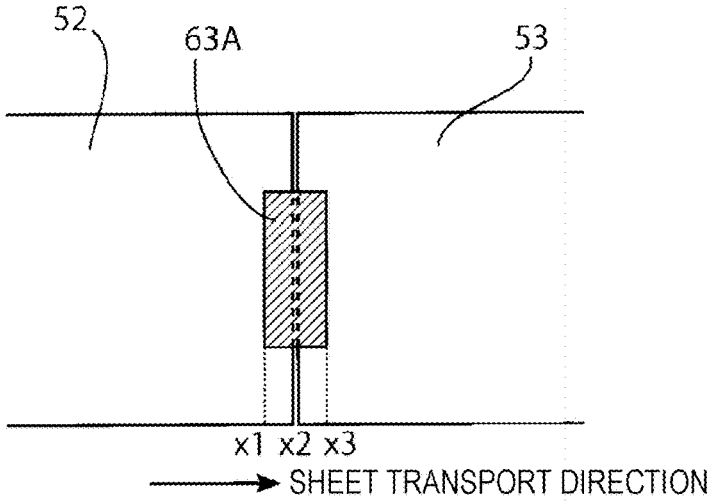

FIG. 12B is an example in which a sheet 63A is bonded, which has a dimensional value in the width direction shorter than the widthwise length of the paper sheet which passes through the sheet 63A. The resistance value of the sheet 63A is at the same level as the level of the sheet 63 of FIG. 12A. The same goes with the sheets 63B to 63J in the later-described modifications of FIGS. 12C to 12E and FIGS. 13A to 13F.

In the case of FIG. 12B, the overall resistance is distributed over three time points: the first is the moment when the rear edge of the transported paper sheet P passes through the position x1, the second is the moment when the rear edge passes through the position x2, and the third is the moment when the rear edge passes through the position x3. Consequently, an adverse effect on the image on the paper sheet P is further reduced, as compared with the case of FIG. 12A.

Figure 12C:
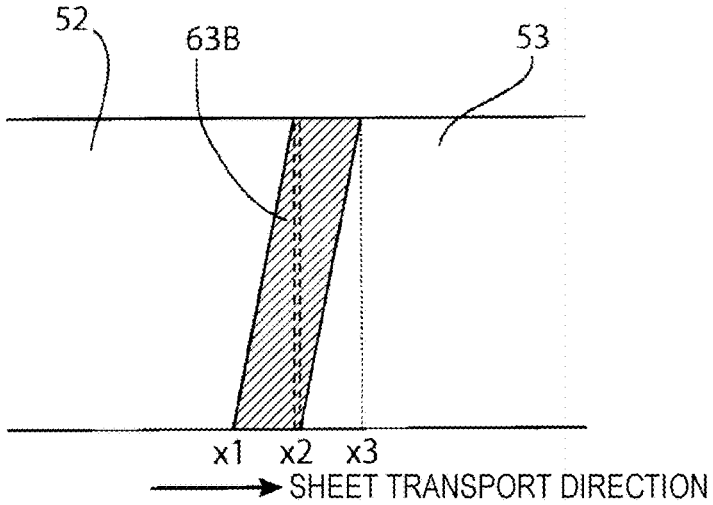

FIG. 12C is an example in which a parallelogram sheet 63B is bonded over the two guiding plates 52, 53.

In this case, during the period from the time when the rear edge of the transported paper sheet P passes through the position x1 to the time when the rear edge passes through the position x2, the length of a portion, of the paper sheet P, in contact with the metal surface of the guiding plate 52 in the sheet width direction is gradually decreased as the paper sheet P is transported to the downstream side, and accordingly, the length of a portion, of the paper sheet P, in contact with the sheet 63B is gradually increased. Consequently, the overall resistance is gradually increased during the period. In addition, during the period from the time when the rear edge of the transported paper sheet P passes through the position x2 to the time when the rear edge passes through the position x3, the length of a portion, of the paper sheet P, in contact with the sheet 63B is gradually decreased as the paper sheet P is transported to the downstream side, and accordingly, the length of a portion, of the paper sheet P, in contact with the guiding plate 53 is gradually decreased. In other words, in the case of FIG. 12C, the overall resistance continues to undergo gradual change from the position x1 to the position x3. Consequently, an adverse effect on the image on the paper sheet P is reduced.

Figure 12D:
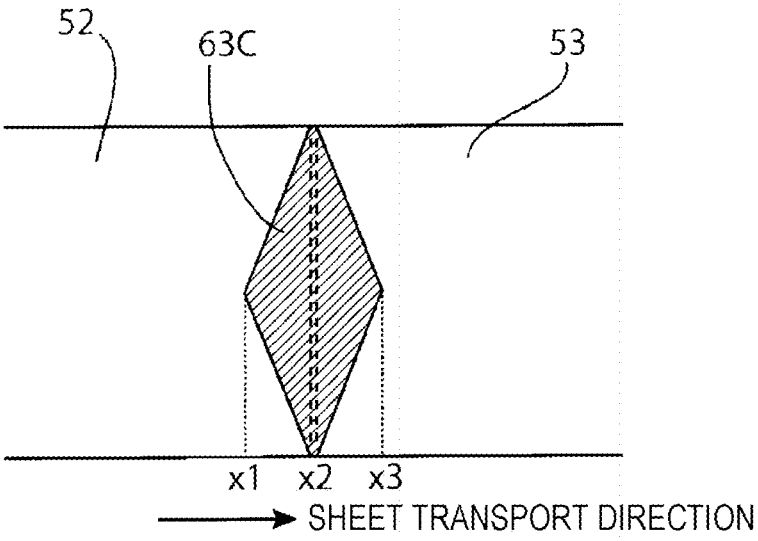

FIG. 12D is an example in which a rhombus sheet 63C is bonded over the two guiding plates 52, 53.

Also in this case, similarly to the case of the parallelogram sheet 63B of FIG. 12C, during the period from the time when the rear edge of the transported paper sheet P passes through the position x1 to the time when the rear edge passes through the position x2, and further during the period from the time when the rear edge passes through the position x2 to the time when the rear edge passes through the position x3, the overall resistance is gradually increased. Consequently, an adverse effect on the image on the paper sheet P is reduced also in the case of FIG. 12D.

Figure 12E:
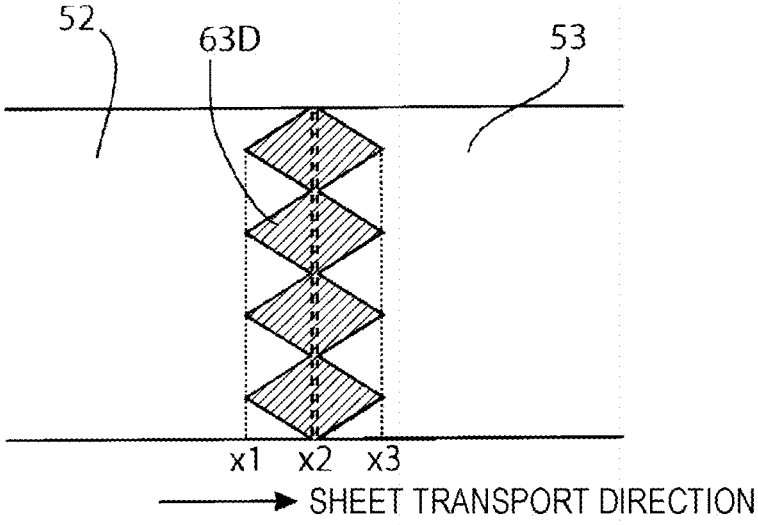

FIG. 12E is an example in which a sheet 63D, in which multiple rhombus are arranged in the sheet width direction, is bonded over the two guiding plates 52, 53.

Also in this case, similarly to the case of the sheets 63B, 63C of FIGS. 12C and 12D, during the period from the time when the rear edge of the transported paper sheet P passes through the position x1 to the time when the rear edge passes through the position x3, the overall resistance is gradually increased. Consequently, an adverse effect on the image on the paper sheet P is reduced also in the case of FIG. 12E.

FIGS. 13A to 13F are views illustrating characteristic portions of further modifications of the sixth exemplary embodiment illustrated in FIG. 12A.

Figure 13A:
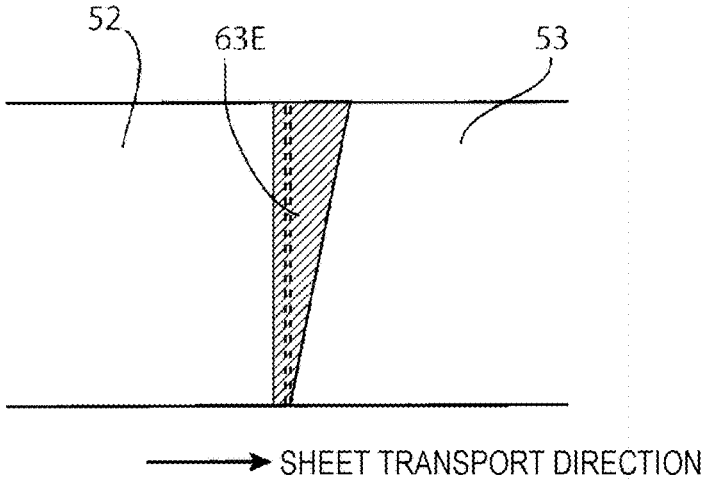
FIGS. 13A to 13F are views illustrating characteristic portions of further modifications of the sixth exemplary embodiment 12A.
Figure 13B:
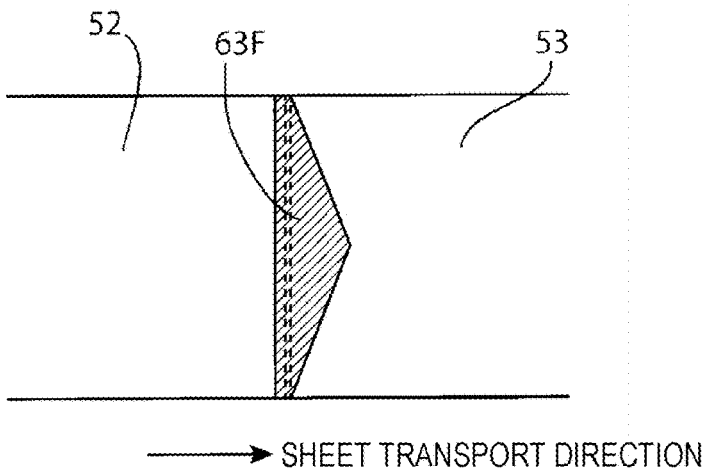
Figure 13C:
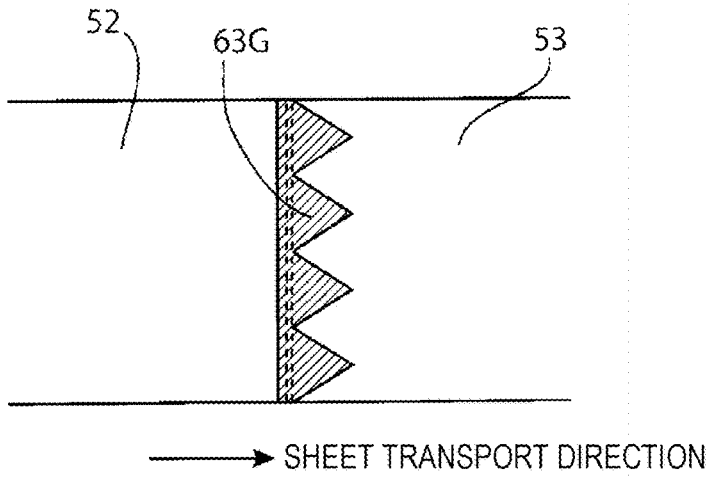

In the sheets 63E, 63F, and 63G illustrated in FIGS. 13A, 13B, and 13C, the portions, of the sheets, bonded to the guiding plate 53 on the downstream side have the same shape as those of the sheets 63B, 63C, and 63D illustrated in FIGS. 12C, 12D, and 12E. In contrast, the portions, of the sheets 63E, 63F, and 63G, bonded to the guiding plate 53 on the upstream side are different from the sheets 63B, 63C, and 63D illustrated in FIGS. 12C, 12D, and 12E, and each have a shape that simply spreads in the width direction of the guiding plate 52.

In order to achieve an acceptable level of change in overall resistance at the moment when the rear edge of the transported paper sheet P is moved from the guiding plate 52 onto the sheets 63E, 63F, and 63G, when each sheet has a resistance close to the resistance of the guiding plate 52 on the upstream side, the sheets 63E, 63F, and 63G having the shape as illustrated in FIGS. 13A, 13B, and 13C may be used.

Figure 13D:
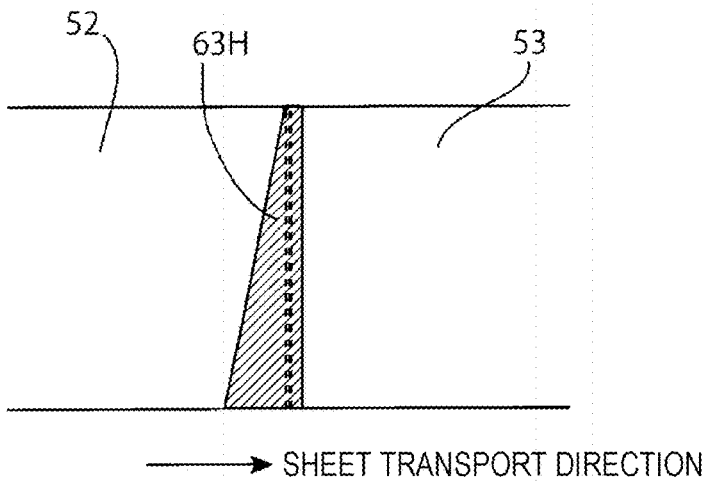
Figure 13E:
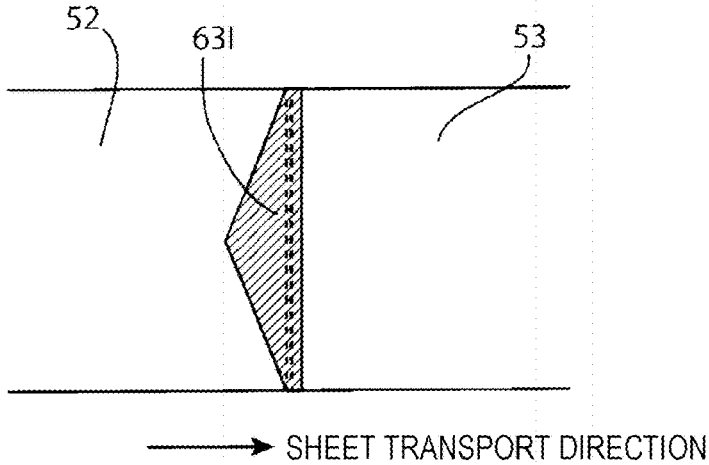
Figure 13F:
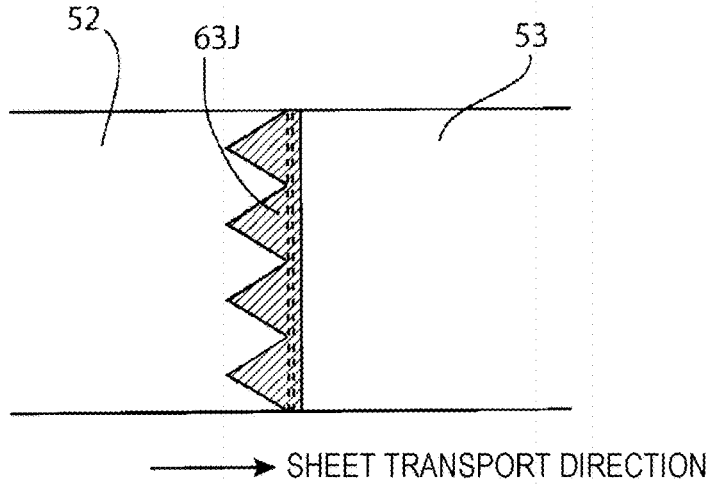

In addition, FIGS. 13D, 13E, and 13F illustrate forms which are approximated to the forms illustrated in FIGS. 5 and 7. Specifically, in the sheets 63H, 63I, and 63J illustrated in FIGS. 13D, 13E, and 13F, the portions, of the sheets, bonded to the guiding plate 52 on the upstream side have the same shape as the corresponding portions of the sheets 63B, 63C, and 63D illustrated in FIGS. 12C, 12D, and 12E. However, the portions, of the sheets 63E, 63F, and 63G, bonded to the guiding plate 53 on the downstream side are different from the sheets 63B, 63C, and 63D illustrated in FIGS. 12C, 12D, and 12E, and each have a shape that simply spreads in the width direction of the guiding plate 53.

In order to achieve an acceptable level of change in overall resistance at the moment when the rear edge of the transported paper sheet P is moved from the sheets 63H, 63I, and 63J onto the guiding plate 53, when each sheet has a resistance close to the resistance of the guiding plate 53 on the downstream side, the sheets 63H, 63I, and 63J having the shape as illustrated in FIGS. 13D, 13E, and 13F may be used.

As in the sixth exemplary embodiment and various modifications illustrated in FIGS. 12A to 12E and FIGS. 13A to 13F, disposing the third member such as a sheet having an intermediate resistance value between the resistance values of the two guiding plates 52, 53 reduces a sudden change in the overall resistance, and it is possible to reduce an adverse effect or avoid an adverse effect on the image on the paper sheet P.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet guiding device comprising:

a first guiding unit that is grounded and guides a sheet transported; and a second guiding unit that is disposed on a downstream side of the first guiding unit and grounded with a resistance higher than a resistance with which the first guiding unit is grounded, and that guides the sheet transported to the first guiding unit to a transfer position interposed between an image carrier that carries a toner image and a transfer unit that transfers the toner image on the image carrier onto the transported sheet by pinching the sheet between the image carrier and the transfer unit and applying an electric field across the image carrier and the transfer unit, wherein the first guiding unit has a dimension decrease area in which on a surface, in contact with the sheet, of the first guiding plate on the downstream side in the sheet transport direction, a dimensional value of a portion including a first material that is a same as the first material used as a material of another surface, in contact with the sheet, of the first guiding plate on an upstream side of the downstream side in a sheet width direction crossing the sheet transport direction is decreased at a more downstream position in the sheet transport direction.

2. The sheet guiding device according to claim 1, wherein the dimension decrease area is an area in which a sheet material including a second material having a resistance higher than a resistance of the first material is disposed on a surface in contact with the sheet on the downstream side in the sheet transport direction.

3. An image forming apparatus comprising:

the sheet guiding device according to claim 2; and an image former that includes the image carrier and the transfer unit, and forms an image on the transported sheet.

4. The sheet guiding device according to claim 1, wherein the dimension decrease area is an area in which coating including a second material having a resistance higher than a resistance of the first material is applied to a surface in contact with the sheet on the downstream side in the sheet transport direction.

5. An image forming apparatus comprising:

the sheet guiding device according to claim 4; and an image former that includes the image carrier and the transfer unit, and forms an image on the transported sheet.

6. The sheet guiding device according to claim 1, wherein the dimension decrease area is formed by a downstream-side edge of the first guiding unit which has a first shape in which a dimensional value of a portion, in contact with a transported paper sheet, of the first guiding unit in a sheet width direction crossing the sheet transport direction is decreased at a more downstream position in the sheet transport direction.

7. The sheet guiding device according to claim 6, wherein in addition to the first shape, the first guiding unit has a second shape in which an upstream-side edge of the second guiding unit in the sheet transport direction extends along the downstream-side edge, which has the first shape, of the first guiding unit.

8. An image forming apparatus comprising:

the sheet guiding device according to claim 7; and an image former that includes the image carrier and the transfer unit, and forms an image on the transported sheet.

9. An image forming apparatus comprising:

the sheet guiding device according to claim 6; and an image former that includes the image carrier and the transfer unit, and forms an image on the transported sheet.

10. The sheet guiding device according to claim 1, further comprising:

a first guiding unit that is grounded and guides a sheet transported;

a second guiding unit that is disposed on a downstream side of the first guiding unit and grounded with a resistance higher than a resistance with which the first guiding unit is grounded, and that guides the sheet transported to the first guiding unit to a transfer position interposed between an image carrier that carries a toner image and a transfer unit that transfers the toner image on the image carrier onto the transported sheet by pinching the sheet between the image carrier and the transfer unit and applying an electric field across the image carrier and the transfer unit; and a third member that is disposed on a surface, of the guiding units, to be in contact with the transported sheet, over from the first guiding unit to the second guiding unit in the sheet transport direction, the third member having a resistance value higher than a resistance value of the first guiding unit and lower than a resistance value of the second guiding unit.

11. The sheet guiding device according to claim 10, wherein the third member has a shape, on the downstream side in the sheet transport direction, in which a dimensional value of a portion, of the third member, in contact with the transported paper sheet in the sheet width direction is decreased at a more downstream position in the sheet transport direction.

12. The sheet guiding device according to claim 11, wherein the third member has a shape, on an upstream side in the sheet transport direction, in which a dimensional value of a portion, of the third member, in contact with the transported paper sheet in the sheet width direction is increased at a more downstream position in the sheet transport direction.

13. An image forming apparatus comprising:

the sheet guiding device according to claim 11; and an image former that includes the image carrier and the transfer unit, and forms an image on the transported sheet.

14. The sheet guiding device according to claim 10, wherein the third member has a shape, on an upstream side in the sheet transport direction, in which a dimensional value of a portion, of the third member, in contact with the transported paper sheet in the sheet width direction is increased at a more downstream position in the sheet transport direction.

15. An image forming apparatus comprising:

the sheet guiding device according to claim 14; and an image former that includes the image carrier and the transfer unit, and forms an image on the transported sheet.

16. The sheet guiding device according to claim 10, wherein the third member has a dimensional value such that the third member is in contact with only part of the transported sheet in the sheet width direction over an entire length of the third member in the sheet transport direction.

17. An image forming apparatus comprising:

the sheet guiding device according to claim 10; and an image former that includes the image carrier and the transfer unit, and forms an image on the transported sheet.

18. An image forming apparatus comprising:

the sheet guiding device according to claim 1; and an image former that includes the image carrier and the transfer unit, and forms an image on the transported sheet.

19. The image forming apparatus according to claim 18, further comprising a constant current source that applies electric power to the transfer unit.

20. The image forming apparatus according to claim 18, further comprising:

a constant voltage source that applies electric power to the transfer unit; and a voltage controller that controls an output voltage of the constant voltage source.

* * * * *